US008590468B2

(12) United States Patent
Fujihara

(10) Patent No.: US 8,590,468 B2
(45) Date of Patent: Nov. 26, 2013

(54) PRESSER DEVICE FOR USE WITH SEWING MACHINE AND SEWING MACHINE

(75) Inventor: Shinya Fujihara, Obu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 344 days.

(21) Appl. No.: 13/185,013

(22) Filed: Jul. 18, 2011

(65) Prior Publication Data

US 2012/0017815 A1 Jan. 26, 2012

(30) Foreign Application Priority Data

Jul. 21, 2010 (JP) ..... 2010-163786

(51) Int. Cl.
*D05B 29/02* (2006.01)

(52) U.S. Cl.
USPC ..... 112/235

(58) Field of Classification Search
USPC ..... 112/235, 236, 237, 238, 239, 240
See application file for complete search history.

(56) References Cited

U.S. PATENT DOCUMENTS 3,494,314 A * 2/1970 Johnson ..... 112/238
4,403,561 A * 9/1983 Schaeflern et al. ..... 112/237
4,709,644 A * 12/1987 Fujihara et al. ..... 112/237
7,325,501 B2 * 2/2008 Yamasaki ..... 112/237
7,958,833 B2 6/2011 Fujihara
2005/0023089 A1 2/2005 Okabayashi et al.
2009/0114133 A1 5/2009 Fujihara

FOREIGN PATENT DOCUMENTS

JP U-6-80039 11/1994
JP A-2005-48929 2/2005
JP A-2009-112325 5/2009

* cited by examiner

*Primary Examiner* — Danny Worrell
(74) *Attorney, Agent, or Firm* — Oliff & Berridge, PLC

(57) ABSTRACT

A presser device for a sewing machine is disclosed. The presser device includes a presser bar; a presser foot provided at a lower end of the presser bar; a presser spring elastically biasing the presser foot downward; a presser-foot lifting lever moved between a lifted position and a lowered position for lifting/lowering of the presser foot; a speed restraining element producing resistance capable of slowing down the movement of the lever; and a speed-restraint switch mechanism that slows down the movement of the presser-foot lifting lever by allowing the speed restraining element to produce the resistance when the presser-foot lifting lever is moved from the lifted position to the lowered position, and that does not slow down the movement of the presser-foot lifting lever by not allowing the speed restraining element to produce the resistance when the presser-foot lifting lever is moved from the lowered position to the lifted position.

17 Claims, 8 Drawing Sheets

PRESSER DEVICE FOR USE WITH SEWING MACHINE AND SEWING MACHINE

CROSS-REFERENCE TO RELATED APPLICATIONS

This application is based upon and claims the benefit of priority from the prior Japanese Patent Application 2010-163786, filed on Jul. 21, 2010, the entire contents of which are incorporated herein by reference.

FIELD

The present disclosure relates to a presser device that moves a presser foot provided at the lower end of a presser bar up and down with a presser-foot lifting lever. The present disclosure also relates to a sewing machine provided with such presser device.

BACKGROUND

Sewing machines are typically provided with a presser device including a presser bar, a presser foot, a presser spring, and a presser-foot lifting lever. The presser bar is supported by the head of the sewing machine so as to be movable up and down. The presser foot is provided at the lower end of the presser bar for applying pressure on the workpiece. Presser spring typically comprises a compression spring and is wound around the presser bar so as to elastically bias the presser foot against the workpiece. Presser-foot lifting lever is configured to move in rotation between the lifted position and the lowered position. The presser device is configured such that the presser foot is lifted/lowered with the presser bar in response to the manual rotation of the presser-foot lifting lever by the user.

Because the presser bar is elastically biased by the presser spring to exert downward pressure on the presser foot, sudden rotation of the presser-foot lifting lever from the lifted position to the lowered position causes sudden rapid fall of the presser foot to result in a hard and noisy impact with the workpiece and the needle plate.

SUMMARY

An object of the present disclosure is to provide a presser device that prevents sudden movement of the presser foot even if the presser-foot lifting lever is suddenly moved in rotation from the lifted position to the lowered position.

In one aspect of the present disclosure, a presser device for a sewing machine is disclosed. The presser device includes a presser bar that is supported by a sewing machine head so as to be movable up and down; a presser foot that is provided at a lower end of the presser bar; a presser spring that elastically biases the presser foot downward; a presser-foot lifting lever that is moved between a lifted position and a lowered position for lifting/lowering of the presser foot; a speed restraining element and a speed-restraint switch mechanism. The speed restraining element produces resistance that is capable of slowing down the movement of the presser-foot lifting lever. The speed-restraint switch mechanism slows down the movement of the presser-foot lifting lever by allowing the speed restraining element to produce the resistance when the presser-foot lifting lever is moved from the lifted position to the lowered position. The speed-restraint switch mechanism does not slow down the movement of the presser-foot lifting lever by not allowing the speed restraining element to produce the resistance when the presser-foot lifting lever is moved from the lowered position to the lifted position.

Other objects, features and advantages of the present disclosure will become clear upon reviewing the following description of the illustrative aspects with reference to the accompanying drawings.

DETAILED DESCRIPTION

With reference to FIGS. 1 to 5, a description will be given hereinafter on a first exemplary embodiment of the present disclosure implemented through a sewing machine.

Figure 1:
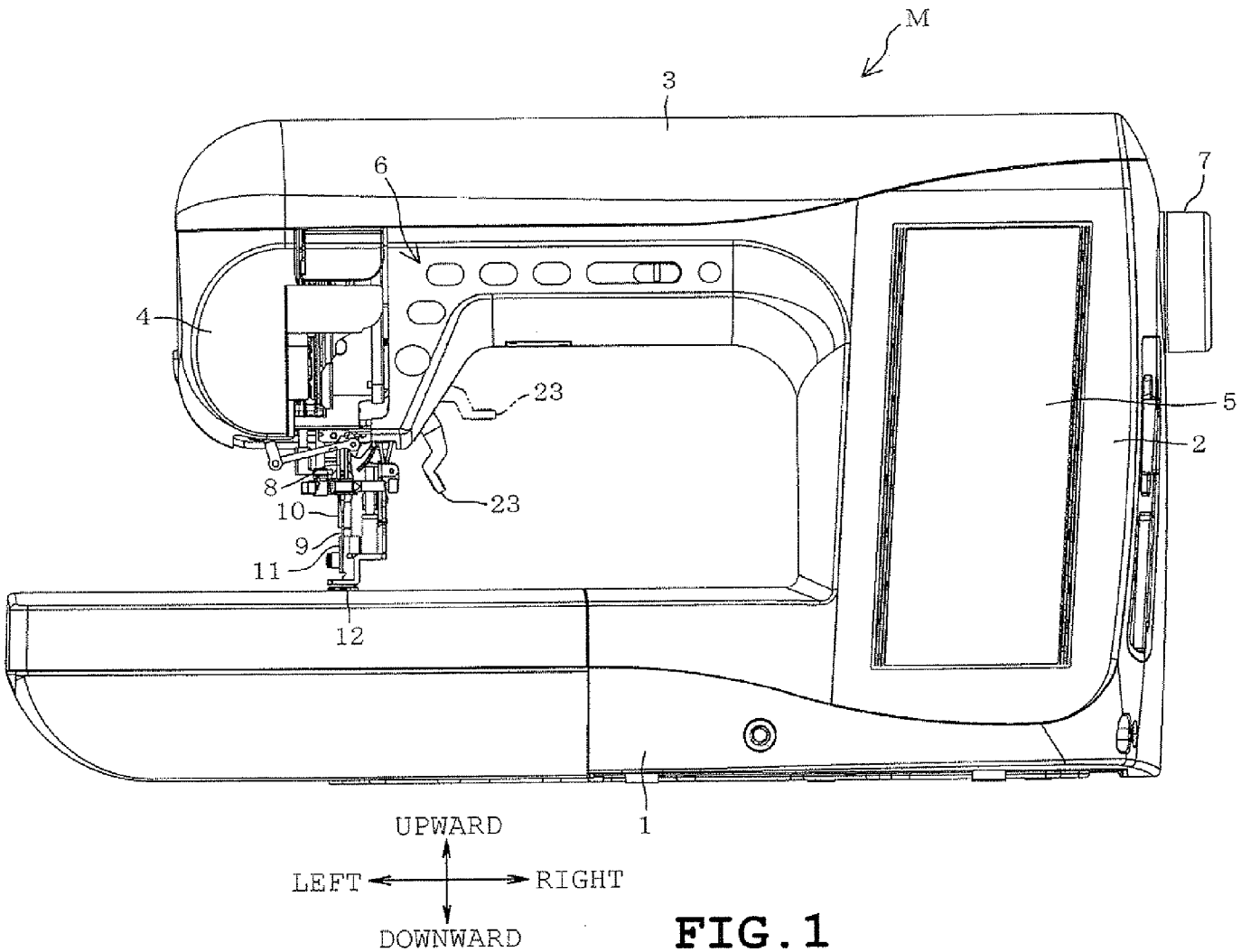
FIG. 1 is a perspective view of a sewing machine according to a first exemplary embodiment of the present disclosure.

Referring to FIG. 1, a general household sewing machine M is shown which is primarily configured by bed 1, pillar 2, arm 3, and head 4 that are structurally integral. Pillar 2 extends upward from the right end of the bed 1. From the upper end of pillar 2, arm 3 extends leftward over bed 1 and the left end extreme of arm 3 terminates into head 4. Pillar 2 has LCD 5 provided on its front face. On the front face of arm 3 and head 4, various operation switches 6 are provided. Description will be given hereinafter with an assumption that: the direction in which the user positions himself/herself to face sewing machine M of FIG. 1 is the forward direction; the direction in which head 4 and arm 3 are located is the upward direction; the direction in which bed 1 is located is the downward direction; and the direction in which arm 3 laterally extends is the leftward and the rightward directions.

Arm 3 contains a sewing machine main shaft not shown and a sewing machine motor also not shown. Sewing machine main shaft extends in the left and right direction and is driven by the sewing machine motor. Arm 3 is provided with hand pulley 7 that allows the user to manually rotate the sewing machine main shaft.

Head 4 is provided with needle bar 8 that has sewing needle 9 attached to its lower end. Needle bar 8 is driven up and down by the rotation of the sewing machine main shaft by way of a needle-bar drive mechanism not shown. Head 4 further includes components such as a needle-swing mechanism not shown, and thread take-up drive mechanism not shown. Needle-swing mechanism swings needle-bar 8 in the left and right direction orthogonal to the direction in which the workpiece is fed. The thread take-up drive mechanism moves the thread take-up not shown in synchronism with the up and down movement of needle bar 8.

Bed 1 contains components such as feed mechanism and a horizontal rotary hook neither of which is shown. The feed mechanism moves a feed dog not shown up and down and back and forth. Horizontal shuttle mechanism forms stitches in coordination sewing needle 9.

Head 4 is further provided with needle bar 10 that is allowed to be moved up/lifted and moved down/lowered. At the lower end of needle bar 10, presser holder 11 is secured on which presser foot 12 is attached as shown in FIG. 2.

Figure 2:
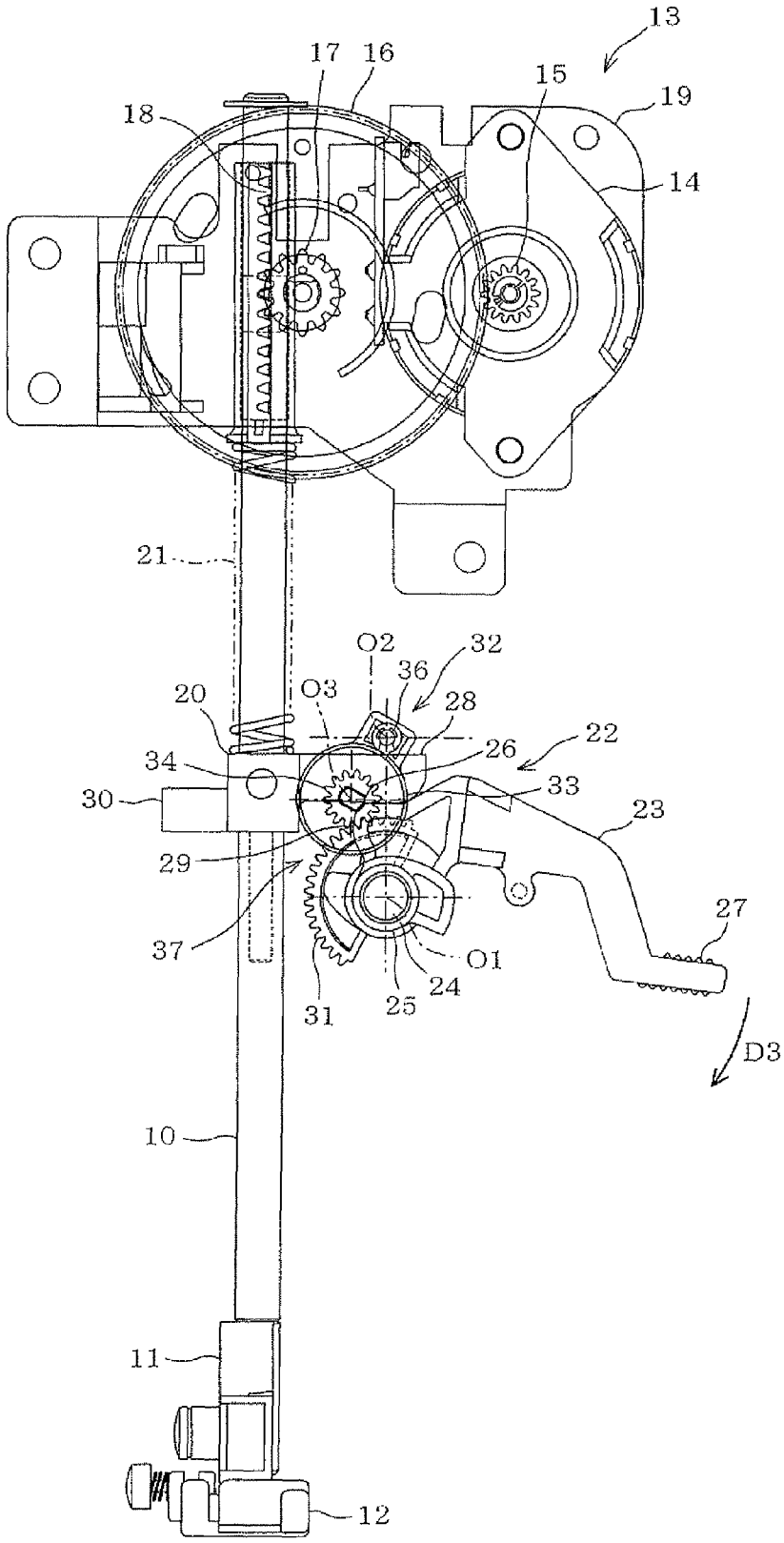
FIG. 2 is a front view of a presser device, a presser bar, and a presser foot when a presser-foot lifting lever is in a lifted position.
Figures 3A, 3B:
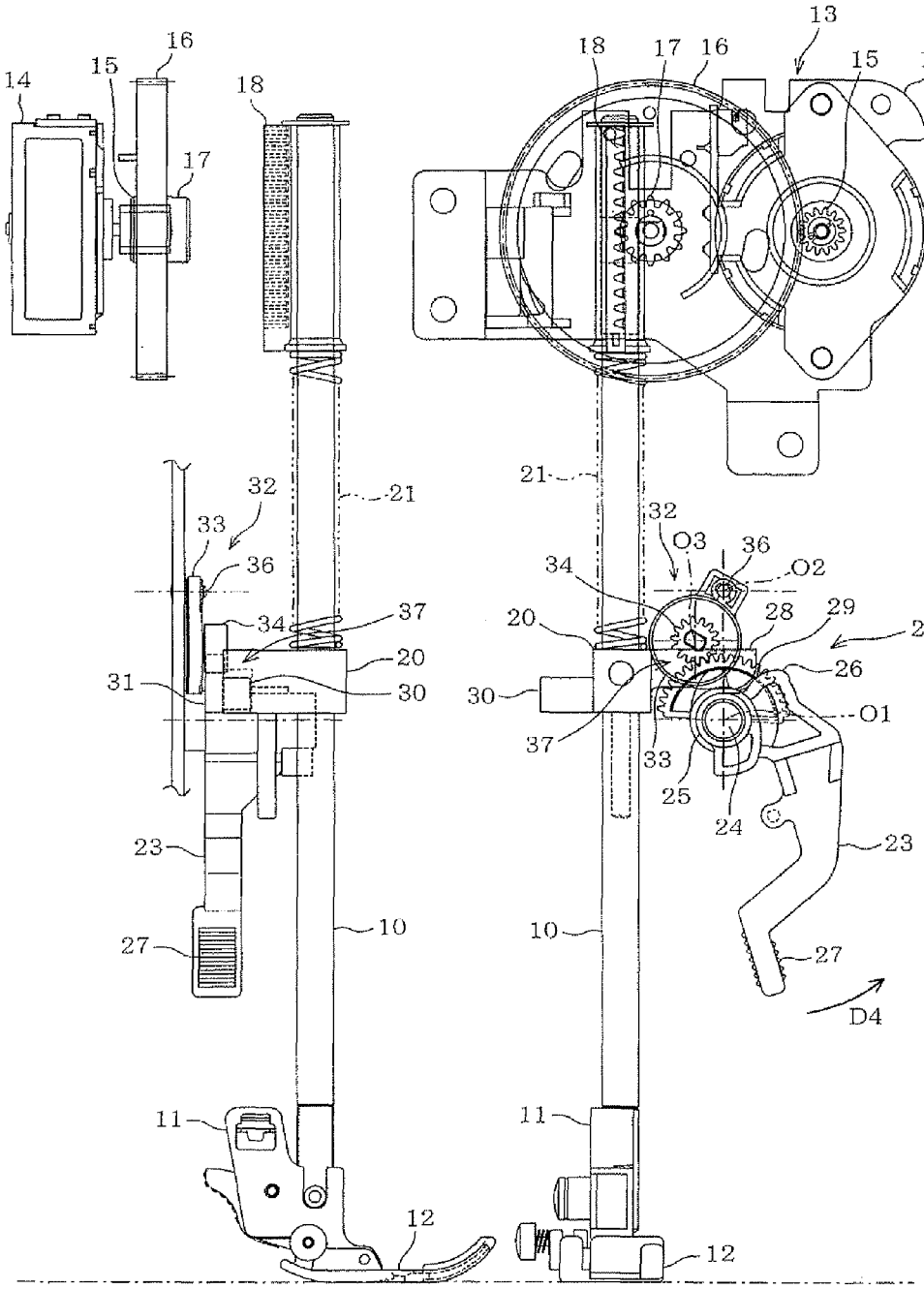
FIGS. 3A and 3B are side and front views of the presser device, the presser bar, and the presser foot when the presser-foot lifting lever is in the lowered position.

Referring to FIGS. 2, 3A and 3B, on the upper portion of needle bar 10, presser-foot vertically moving mechanism 13 is provided that is configured to move presser foot 12 up and down. Presser-foot vertically moving mechanism 13 is configured by components such as pressure adjustment motor 14, drive gear 15, pressure adjustment gear 16, pressure adjustment pinion 17, and pressure adjustment rack 18. Pressure adjustment motor 14 is secured to head 4 by way of motor holder 19. Drive gear 15 is secured on the output shaft of pressure adjustment motor 14 and rotates integrally with the output shaft. Drive gear 15 meshes with pressure adjustment gear 16 such that pressure adjustment gear 16 follows the rotation of drive gear 15. Pressure adjustment pinion 17 is structurally integral with pressure adjustment gear 16. Pressure adjustment pinion 17 meshes with pressure adjustment rack 18 and thus, pressure adjustment rack 18 is moved up/lifted and is moved down/lowered in response to the rotation of pressure adjustment pinion 17.

At a vertical mid portion of presser bar 10, presser-bar clamp 20 is secured. Further, presser spring 21 is wound around a portion of presser bar 10 between pressure adjustment rack 18 and presser-bar clamp 20. Compression spring 21 contacts the upper end of presser-bar clamp 20 to elastically bias presser bar 10 downward to depress the workpiece or the needle plate. Thus, when a later described presser-foot lifting lever is in the lowered position, presser foot 12 is depressed against a needle plate not shown provided on the upper surface of bed 1 or against the workpiece not shown placed on the needle plate.

Head 4 is provided with presser device 22 that is provided with presser-foot lifting lever 23 used for lifting/lowering of presser foot 12. Presser-foot lifting lever 23 is formed to substantially exhibit a crank like shape. At the base end of presser-foot lifting lever 23, a cylindrical sleeve 25 for receiving insertion of lever shaft 24 secured to head 4 is provided as well as presser-foot lifting cam 26 being structurally integral with sleeve 25. At the extreme end or the tip in the opposite side of the base end of the presser-foot lifting lever 23, handle 27 is provided for the user's manual operation. Presser-foot lifting cam 26 takes an uprising shape so as to gradually increase the outer diametric dimension of sleeve 25. The outer peripheral surfaces of sleeve 25 and presser-foot lifting cam 26 serves as cam surface 29 for establishing contact with the underside of arm 28 that protrudes rightward from presser-bar clamp 20.

Presser-foot lifting lever 23 is pivoted around lever shaft 24 so as to rotate between the lifted position shown in FIG. 2 and the lowered position shown in FIGS. 3A and 3B. Rotation of presser-foot lifting lever 23 by the user allows lifting/lowering of presser bar 10 independent of lifting/lowering of presser bar 10 by presser-foot lifting/lowering mechanism 13. This means that presser bar 10 as well as presser foot 12 attached to the lower end of presser bar 10 is lifted/lowered in response to the rotation of presser-foot lifting lever 23.

As shown in FIG. 2, when presser-foot lifting lever 23 is in the lifted position, the underside of arm 28 of needle-bar clamp 20 is pressed in contact with cam surface 29 of presser-foot lifting lever 23. The point of contact between arm 28 and cam surface 29 resides substantially vertically above the axial center represented as O1 in FIG. 2 of shaft lever 24. Thus, no force is imparted on presser-foot lifting lever 23 to turn itself clockwise nor counterclockwise and presser-foot lifting lever 23 stays locked in the lifted position.

Figure 4A:
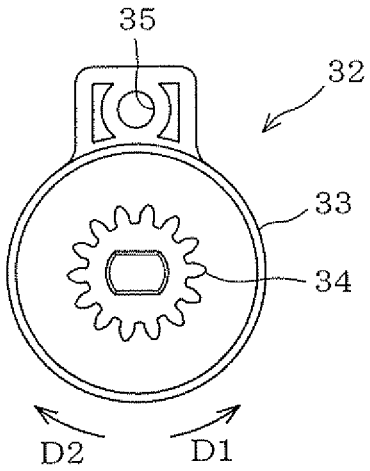
FIGS. 4A and 4B are front and side views of a rotary damper.
Figure 4B:
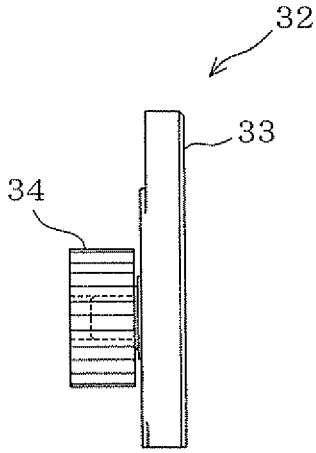

Presser-foot lifting lever 23 is provided with a semicircular first gear 31 which is structurally integral with presser-foot lifting lever 23. The center of the pitch circle of first gear 31 and axial center O1 of lever shaft 24 are coincidental. Above presser-foot lifting lever 23, rotary damper 32 is disposed which is primarily configured by body 33, second gear 34, and insert hole 35 as can be seen in FIGS. 4A and 4B. Rotary damper 32 is supported by head 4 through insertion of support shaft 36 secured to head 4 into insert hole 35. Rotary damper 32 is thus, swingably supported, by its own weight or gravity, around support shaft 36. Within body 33, highly viscous grease not shown in sealed. Thus, when second gear 34 is rotated in either direction indicated by arrow D1 or D2 of FIG. 4A, the grease produces resistance oriented in the direction opposite the direction of rotation. Second gear 34 rotates through meshing with first gear 31.

Figure 5C:
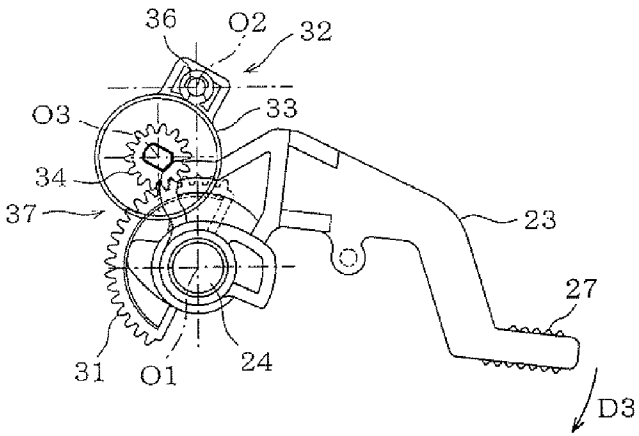
FIGS. 5A to 5C each illustrates a speed restraining element with the presser-foot lifting lever in different positions.
Figure 5B:
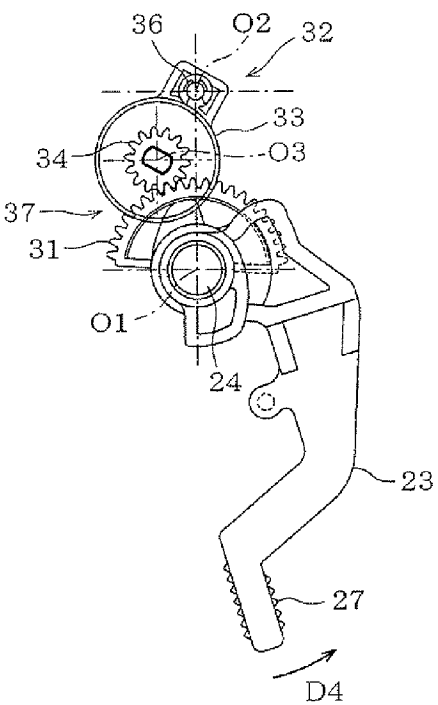
Figure 5A:
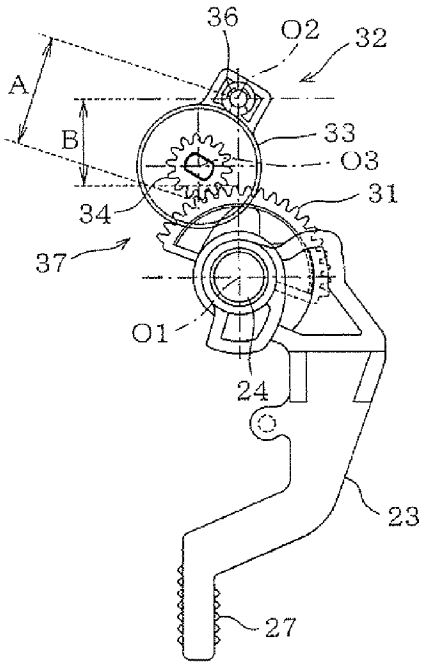

As can be seen in FIGS. 2, 3A, 3B, and 5A to 5C, axial center O2 of support shaft 36, around which rotary damper 32 swings, is located on the extension of an imaginary vertical straight line that passes through axial center O1 of lever shaft 24. Further, axial center O3 of second gear 34 is displaced to the left of the imaginary straight line. Stated differently, length A indicated in FIG. 5A, which is a sum of the distance between axial center O2 of support shaft 36 and axial center O3 of second gear 34 and the radius of the pitch circle of second gear 34, is configured to be greater than length B indicated in FIG. 5A, which is a difference obtained by subtracting the radius of the pitch circle of first gear 31 from the distance between axial center O2 of support shaft 36 and axial center O1 of lever shaft 24. Because the pitch circles of first gear 31 and second gear 34 are imaginary circles, FIG. 5A illustrates distances A and B being measured in alignment with the addendum circles of first and second gears 31 and 34. First gear 31 of presser-foot lifting lever 23 and second gear 34 of rotary damper 32 constitute speed-restraint switch mechanism 37.

Next, a description will be given on the working of presser device 22.

When presser-foot lifting lever 23 is in the lifted position, presser bar 10 and presser foot 12 are located in the lifted position as well. Then, when the user rotates presser-foot lifting lever 23 clockwise in the direction of arrow D3 indicated in FIGS. 2 and 5C to rotate presser-foot lifting lever 23 from the lifted position to the lowered position, cam surface 29 of presser-foot lifting lever 23 slides in contact with the underside of arm 28 of presser-bar clamp 20 to move presser-bar clamp 20 downward by the spring force of compression spring 21. Thus, presser bar 10 as well as presser foot 12 is lowered. The clockwise rotation of presser-foot lifting lever 23 causes first gear 31 to rotate clockwise. At this instance, second gear 34 of rotary damper 32 being meshed with first gear 31 receives the rotational force of first gear 31. The transmission of the rotational force from first gear 31 to second gear 32 will be described in detail hereinafter.

The clockwise rotational force of first gear 31 translates to a force to rotate second gear 34 counterclockwise and a force to move/swing second gear 34 itself, more generally, rotary damper 32 itself rightward. Because the aforementioned distance A is configured to be greater than distance B, rotary damper 32 receives rightward force from first gear 31 to retain second gear 34 at the position to mesh with first gear 31, where second gear 34 is rotated counterclockwise by the clockwise rotation of first gear 31. At this instance, rotary damper 32 produces resistance against the rotation of second gear 34. The resistance against the counterclockwise rotation of second gear 34, produced by rotary damper 32 during the rotation of presser-foot lifting lever 23 from the lifted position to the lowered position, is transmitted to first gear 31 to reduce the speed in which presser-foot lifting lever 23 is moved from the lifted position to the lowered position. This means that the resistance slows down the movement of presser-foot lifting lever 23 to act like a brake.

In contrast, when presser-foot lifting lever 23 is in the lowered position, presser bar 10 and presser foot 12 are located in the lowered position as well in which state presser foot 12 is placed in contact with the workpiece or the needle plate. Then, when the user rotates presser-foot lifting lever 23 counterclockwise in the direction of arrow D4 indicated in FIGS. 3 and 5B to rotate presser-foot lifting lever 23 from the lowered position to the lifted position, cam surface 29 of presser-foot lifting lever 23 slides in contact with the underside of arm 28 of presser-bar clamp 20 to move presser-bar clamp 20 upward against the spring force of compression spring 21. Thus, presser bar 10 as well as presser foot 12 is lifted. The counterclockwise rotation of presser-foot lifting lever 23 causes first gear 31 to rotate counterclockwise. The counterclockwise rotational force of first gear 31 translates to a force to rotate second gear 34 clockwise and a force to move/swing second gear 34 itself, more generally, rotary damper 32 itself leftward.

However, because rotary damper 32 is supported swingably, by its own weight, around support shaft 36, the rotational force of first gear 31 does not operate as a force to rotate second gear 34, but as a force to move or lift rotary damper 32 leftward or leftwardly upward against the weight of rotary damper 32. Because the weight of rotary damper 32 is arranged to be less than the resistance produced by second gear 34, second gear 34 is moved to a position where it does not mesh with first gear 31 and thus, second gear 34 does not rotate. As described above, because second gear 34 does not mesh with first gear 31 and thus, does not rotate when presser-foot lifting lever 23 is moved from the lowered position to the lifted position, rotary damper 32 does not produce any resistance, thereby allowing presser-foot lifting lever 23 to be moved smoothly with light user operation.

Next, a description will be given on the relation between distance A and distance B. When distance A is extended with distance B intact, the angle of inclination of the imaginary straight line passing through axial center O2 of support shaft 36 and rotational center O3 of second gear 34 becomes more gradual. Under such arrangement, the clockwise rotation of first gear 31 causes rotary damper 32 to move or swing obliquely leftward against the weight of rotary damper 32, in which case second gear 34 does not mesh with first gear 31, possibly causing first gear 31 to rotate idly. Though also dependent on the relation between the weight and the resistance produced by rotary damper 32 as well as the gear ratio between first gear 31 and second gear 34, it is preferable to control distance A to proximate distance B. However, when distance A and distance B are substantially equalized, variations in the dimensions of parts being employed or backlashes of gears may cause rotational center O3 of second gear 34 to be moved unwantedly to the right side of the imaginary straight line passing through axial center O1 of lever shaft 24 and axial center O2 of support shaft 36. This obviously prevents proper functioning of speed-restraint switch mechanism 37. Distance A and distance B thus, need to be properly and carefully specified.

Rotary damper 32 according to the first exemplary embodiment is configured to swing by its own weight. Though more parts are required, rotary damper 32 may be configured to be constantly biased counterclockwise by a spring member. When the weight of rotary damper 32 is utilized, interworking components need to be carefully located based on the direction in which the weight of rotary damper 32 operates which is, in this case, the gravitational direction. Provision of the aforementioned spring member improves the flexibility in the positioning of the interworking components while allowing speed-restraint switch mechanism 37 to function more reliably.

As described above, the presser device according to the first exemplary embodiment slows down the movement of presser-foot lifting lever 23 by way of the resistance produced by rotary damper 32 during the movement of presser-foot lifting lever 23 from the lifted position to the lowered position. As a result, presser-foot lifting lever 23 can be moved from the lifted position to the lowered position more slowly compared to the conventional configuration. This prevents the sudden fall and consequently the hard impact of presser foot 12 with workpiece or needle plate. In contrast, when presser-foot lifting lever 23 is moved from the lowered position to the lifted position, rotary damper 32 does not produce any resistance and thus, presser-foot lifting lever 23 can be operated smoothly with light force.

Rotary damper 32 is configured to produce or not produce any resistance depending upon the relative positioning of first gear 31 of presser-foot lifting lever 23 and second gear 34 of rotary damper 32 which is simple in structure and cost effective. Further, locating second gear 34 above first gear 31 and arranging rotary damper 32 to be supported swingably by utilizing its own weight allows further simplification of structure.

The distance obtained by the sum of the distance between axial center O2 of support shaft 36 and rotation center O3 of second gear 34 and the radius of the pitch circle of second gear 34 is configured to be greater than the distance obtained by subtracting the radius of the pitch circle of first gear 31 from the distance between axial center O2 of support shaft 36 and axial center O1 of lever shaft 24. This arrangement allows the weight of rotary damper 32 to be utilized more effectively. The resistance is applied to presser-foot lifting lever 23 and thus, does not affect the working of needle bar 10 when the sewing operation is ongoing.

Figure 6C:
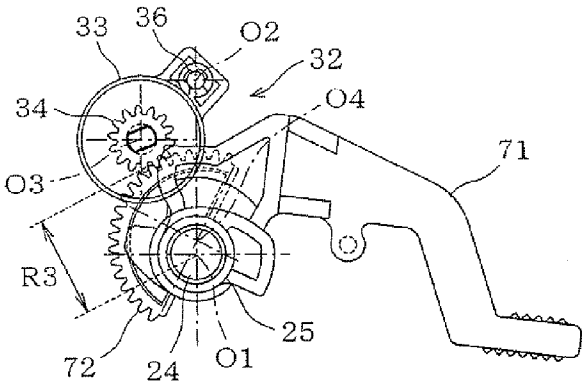
FIGS. 6A to 6C illustrate a second exemplary embodiment of the present disclosure and correspond to FIGS. 5A to 5C.
Figure 6B:
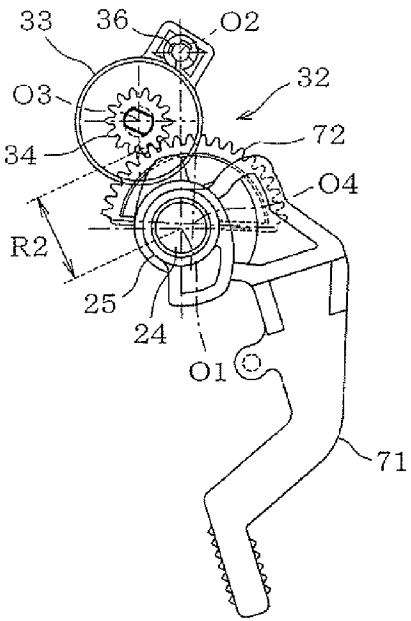
Figure 6A:
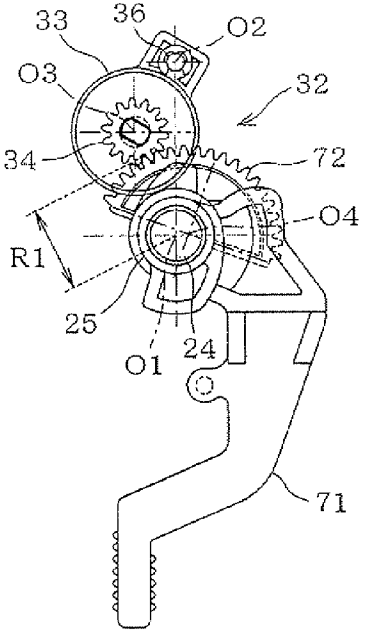

FIGS. 6A to 6C illustrate a second exemplary embodiment of the present disclosure which will be described hereinafter based primarily on the differences from the first exemplary embodiment. Similar or identical reference symbols are used for portions/components that are similar or identical to the first exemplary embodiment. The second exemplary embodiment differs from the first exemplary embodiment in that the center of the pitch circle of the first gear of the presser-foot lifting lever is eccentric with the axial center of lever shaft 24 by a predetermined distance.

More specifically, presser-foot lifting lever 71 is provided with a semicircular first gear 72 which is structurally integral with presser-foot lifting lever 71. The center of the pitch circle of first gear 72, represented by O4 in FIGS. 6A to 6C, is displaced from the axial center of lever shaft 24, represented by O1 in FIGS. 6A to 60. According to this arrangement, the distance between axial center O1 of lever shaft 24 and the location or the point of engagement where first gear 72 meshes with second gear 34 is gradually reduced as presser-foot lifting lever 71 is lowered. This variation in the distance is illustrated in FIGS. 6A to 60 where R1<R2<R3. Thus, the resistance produced by rotary damper 32 is transmitted to first gear 72 by way of second gear 34 such that the resistance is gradually reduced, meaning that the spring force of presser spring 21 is also gradually reduced as presser-foot lifting lever 71 is moved from the lifted position to the lowered position. Because the resistance received by first gear 72 and consequently presser-foot lifting lever 71 is configured to gradually reduce, presser-foot lifting lever 71 can be moved smoothly as compared to the configuration in which constant resistance is imparted.

According to the above described second exemplary embodiment, center O4 of the pitch circle of first gear 72 is displaced or decentered from axial center O1 of lever shaft 24. Thus, adjustments can be made on the resistance imparted on presser-foot lifting lever 71 by rotary damper 32 depending upon the position of presser-foot lifting lever 71. Hence, presser-foot lifting lever 71 can be lowered smoothly from the lifted position to the lowered position. Thus the resistance imparted on presser-foot lifting lever 71 by rotary damper 32 can be adjusted as required by varying the distance between or the amount of eccentricity of shaft center O1 of lever shaft 24 and center O4 of pitch circle of first gear 72, in other words, by varying the location of center O4 of first gear 72 relative to axial center O1 of lever shaft 24.

Figure 7:
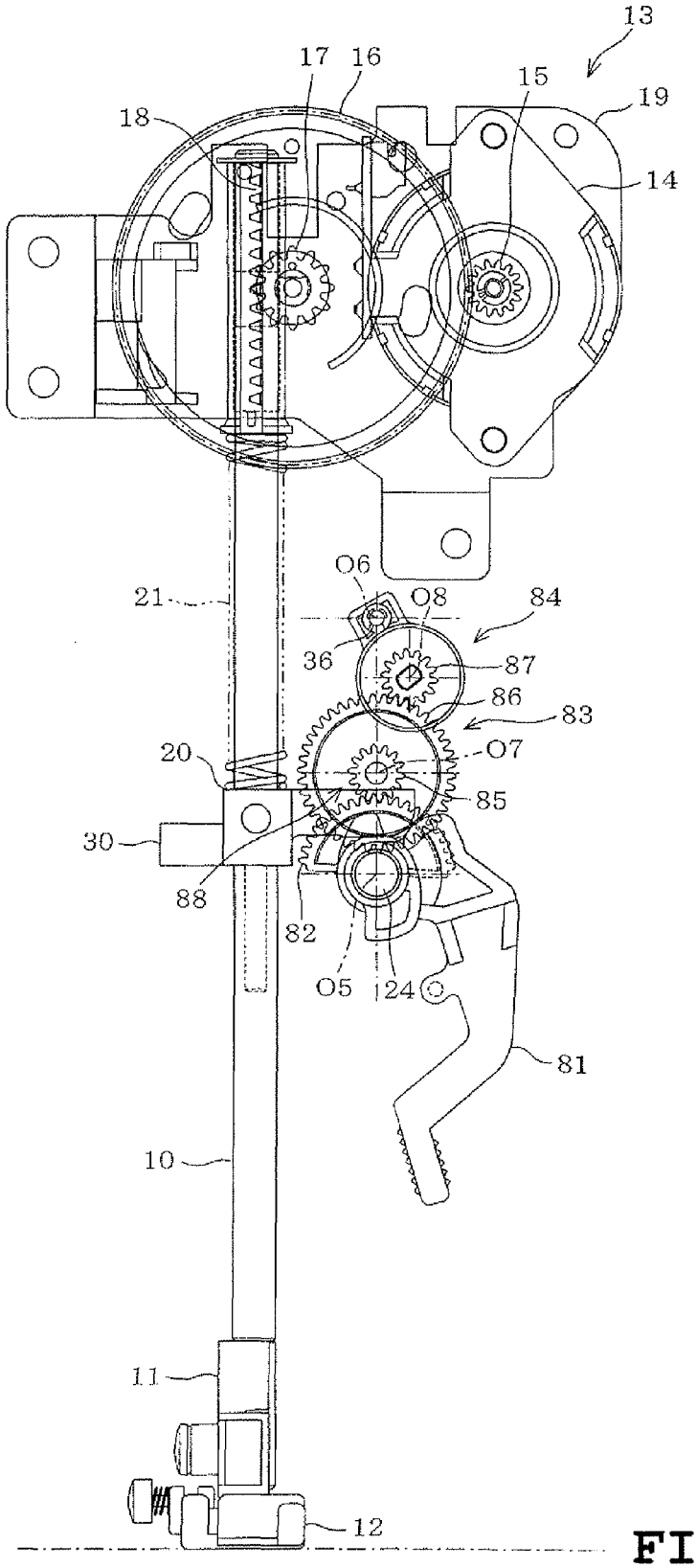
FIG. 7 illustrates a third exemplary embodiment of the present disclosure and depicts the presser device, the presser bar, and the presser foot when the presser-foot lifting lever is in the lowered position.

FIG. 7 illustrates a third exemplary embodiment of the present disclosure which will be described hereinafter based primarily on the differences from the first exemplary embodiment. Similar or identical reference symbols are used for portions/components that are similar or identical to the first exemplary embodiment. The third exemplary embodiment differs from the first exemplary embodiment in that an intermediate gear is provided between the first gear of the presser-foot lifting lever and the second gear of the rotary damper in which case the rotational force of the first gear is transmitted to the second gear through the intermediate gear.

Thus, presser-foot lifting lever 81 according to the third exemplary embodiment is similar in structure to presser-foot lifting lever 23 described in the first exemplary embodiment and is supported so as to be rotatable between the lifted position and the lowered position around lever shaft 24. Presser-foot lifting lever 81 is provided with a semicircular first gear 82 which is structurally integral with presser-foot lifting lever 81. The center of the pitch circle of first gear 82 and the axial center represented as O5 in FIG. 7 of lever shaft 24 are coincidental.

In the above presser-foot lifting lever 81, intermediate gear 83 is provided rotatably at the support shaft not shown secured to head 4. Above intermediate gear 83, rotary damper 84 is swingably supported around support shaft 36 secured to head 4. Intermediate gear 83 is provided with small gear 85 and large gear 86 that are structurally integral with intermediate gear 83. Rotary damper 84 is provided with second gear 87.

First gear 82 of presser-foot lifting lever 81 and small gear 85 of intermediate gear 83 are rotatable in mesh with each other. Similarly, second gear 87 of rotary damper 84 and large gear 86 of intermediate gear 83 are rotatable in mesh with each other. Axial center O6 of support shaft 36 shown in FIG. 7, around which rotary damper 84 swings, and rotational center O7 of intermediate gear 83 shown in FIG. 7 are configured to be located on the extension of an imaginary vertical straight line that passes through axial center O5 of lever shaft 24 shown in FIG. 7. Further, rotational center O8 of second gear 84 show/n in FIG. 7 is displaced to the right of the imaginary straight line.

According to the third exemplary embodiment configured as described above, the rotational force of first gear 82 is transmitted to second gear 87 through intermediate gear 83. At this instance, large gear 86 and second gear 87 are meshed, whereby resistance is produced by rotary dumper 84 when presser-foot lifting lever 81 is lowered as was the case in the first exemplary embodiment. In contrast, when presser-foot lifting lever 81 is lifted, large gear 86 and second gear 87 are not meshed and thus, rotary damper 84 does not produce any resistance. The provision of intermediate gear 83 allows the rotation angle of second gear 87 relative to the rotation angle of first gear 82 to be greater than that of the first exemplary embodiment. Thus, the resistance produced by rotary damper 84 can be made smaller than the first exemplary embodiment. Speed-restraint switch mechanism 88 according to the third exemplary embodiment is configured by first gear 82 of presser-foot lifting lever 81, intermediate gear 83, and second gear 87 of rotary damper 84.

According to the third exemplary embodiment, the rotational force of first gear 82 is transmitted to second gear 87 through intermediate gear 83. As a result, the resistance produced by rotary damper 84 can be reduced as compared to the configuration of the first exemplary embodiment, to allow downsizing of rotary damper 84 which in turn improves space efficiency. Further, it is not mandatory for axial center O6 of support shaft 36 and rotational center O7 of intermediate gear 83 to reside on the extension of the vertically oriented imaginary straight line passing through axial center O5 of lever shaft 24. Thus, there is greater flexibility in the layout of intermediate gear 83 and rotary damper 84.

Figure 8C:
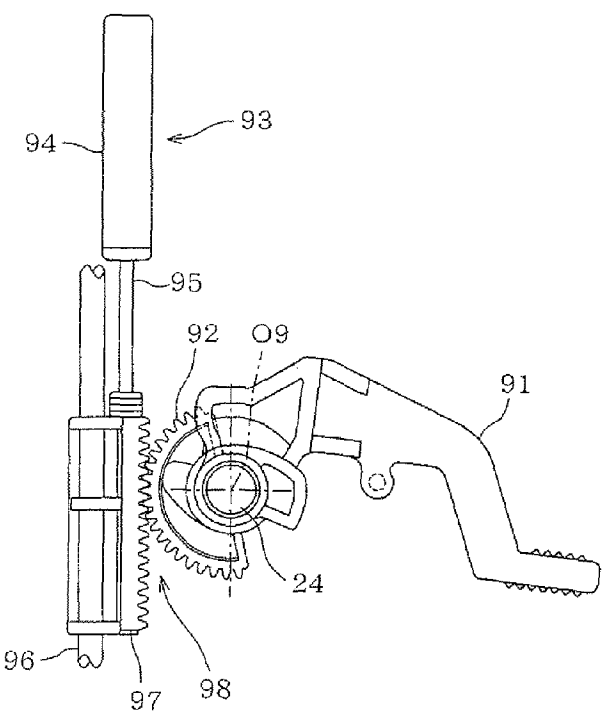
FIGS. 8A to 8C illustrate a fourth exemplary embodiment of the present disclosure and corresponds to FIGS. 5A to 5C.
Figure 8B:
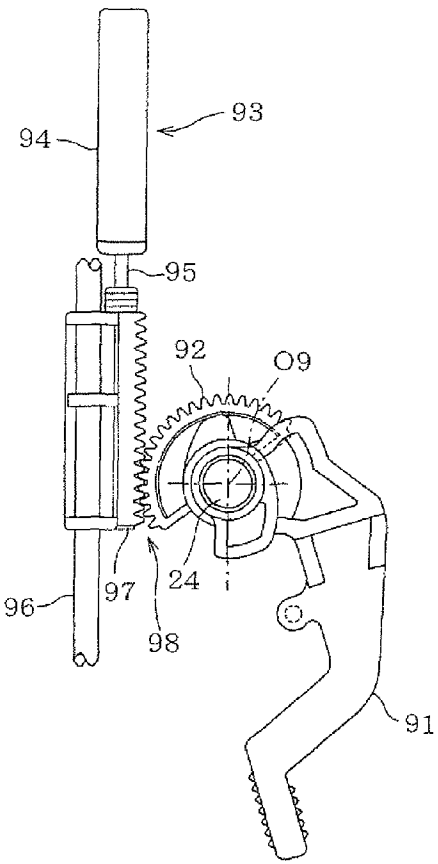
Figure 8A:
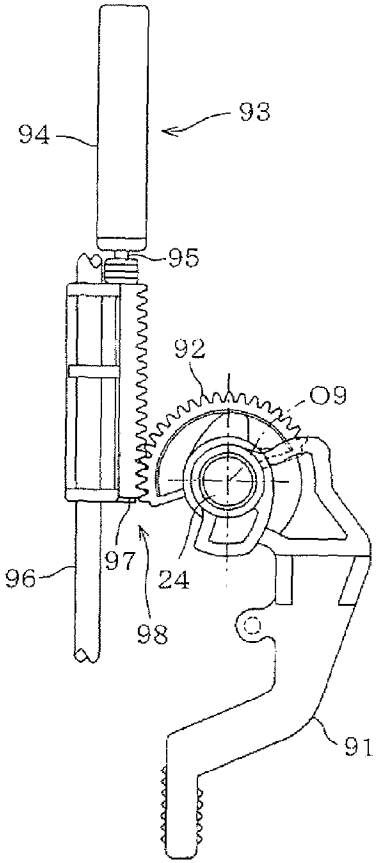

FIGS. 8A to 8C illustrate a fourth exemplary embodiment of the present disclosure which will be described hereinafter based primarily on the differences from the first exemplary embodiment. Similar or identical reference symbols are used for portions/components that are similar or identical to the first exemplary embodiment. The fourth exemplary embodiment differs from the first exemplary embodiment in that a linear damper is employed instead of a rotary damper.

Presser-foot lifting lever 91 according to the fourth exemplary embodiment is similar in structure to presser-foot lifting lever 23 described in the first exemplary embodiment and is supported so as to be rotatable between the lifted position and the lowered position around lever shaft 24. Presser-foot lifting lever 91 is provided with a semicircular third gear 92 which is structurally integral with presser-foot lifting lever 91. The center of the pitch circle of third gear 92 and the axial center represented as O9 in FIGS. 8A to 8C of lever shaft 24 are coincidental.

Provided rightwardly above presser-foot lifting lever 91 is linear damper 93 that is primarily configured by body 94, damper shaft 95, and a compression spring not shown. Body 94 is secured to head 4. Damper shaft 95 is supported by body 94 so as to be movable up and down relative to body 94 typically through extending and contracting. The compression spring keeps damper shaft 95 extended downward relative to body 94. Inside body 94, highly viscous grease not shown is sealed to produce resistance oriented in the direction opposite the direction in which damper shaft 95 is moved.

Head 4 has rack slider shaft 96 secured to it that extends in the up and down direction. Rack slider shaft 96 has rack 97 slidably supported to it. Rack 97 meshing with third gear 92 of presser-foot lifting lever 91 slides up and down in response to the rotation of presser-foot lifting lever 91. In operation, lifting of presser-foot lifting lever 91 moves rack 97 downward, whereas lowering of presser-foot lifting lever 91 moves rack 97 upward. When rack 97 is raised, the upper end of rack 97 contacts the lower end of damper shaft 95 whereby damper shaft 95 is moved upward and contracted. This causes body 94 to produce resistance. In contrast, when rack 97 is lowered, the spring force of the compression spring causes damper shaft 95 to stretch downward. Because damper shaft 95 is subjected to constant resistance against its direction of movement, damper shaft 95 moves slower as compared to rack 97. This means that, damper shaft 95 is lowered with slight delay after the lowering of rack 97. Speed-restraint switch mechanism 98 is configured by third gear 92 of presser-foot lifting lever 91 and rack 97 of linear dumper 93.

According to the fourth exemplary embodiment, rotation of presser-foot lifting lever 91 from the lifted position to the lowered position causes the rotation of third gear 92, whereby rack 97 and damper shaft 95 are raised. Thus, linear damper 93 produces resistance to slow down the movement of presser-foot lifting lever 91 from the lifted position to the lowered position. Because the lowering of presser foot 12 is slowed down by the above described arrangement, it is no longer subjected to hard impact with the needle plate. In contrast, rotation of presser-foot lifting lever 91 from the lowered position to the lifted position causes rotation of third gear 92 which, in this case, lowers rack 97 prior to damper shaft 95. Thus, the resistance of linear damper 93 is not imparted on presser-foot lifting lever 91. The user is thus, allowed to turn presser-foot lifting lever 91 smoothly with a light operation.

The present disclosure is not limited to the foregoing exemplary embodiments but may be expanded or modified as follows.

The present disclosure may be applied to a presser device which is not provided with presser-foot lifting/lowering mechanism 13.

The first exemplary embodiment may be modified such that axial center O2 of support shaft 36 around which rotary damper 32 swings may be displaced from the extension of the vertically oriented imaginary straight line passing through axial center O1 of lever shaft 24 around which presser-foot lifting lever 23 rotates.

Rotary damper 32 and linear damper 93 may be configured as a one way damper that produces resistance in only one of the directions in which they are moved. In such case, rotary damper 32 need not be allowed to swing but may be secured to head 4.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A presser device for a sewing machine, comprising:

a presser bar that is supported by a sewing machine head so as to be movable up and down;

a presser foot that is provided at a lower end of the presser bar;

a presser spring that elastically biases the presser foot downward;

a presser-foot lifting lever that is moved between a lifted position and a lowered position for lifting/lowering of the presser foot;

a speed restraining element that produces resistance capable of slowing down the movement of the presser-foot lifting lever; and a speed-restraint switch mechanism that slows down the movement of the presser-foot lifting lever by allowing the speed restraining element to produce the resistance when the presser-foot lifting lever is moved from the lifted position to the lowered position, and that does not slow down the movement of the presser-foot lifting lever by not allowing the speed restraining element to produce the resistance when the presser-foot lifting lever is moved from the lowered position to the lifted position.

2. The device according to claim 1, wherein the speed-restraint switch mechanism includes:

a first rotary member that rotates in conjunction with the presser-foot lifting lever; and a second rotary member that is provided at the speed restraining element and that is capable of rotating in engagement with the first rotary member, the rotation of the second rotary member being slowed down by the resistance;

wherein the second rotary member is movable between an engaged position being engaged with the first rotary member and a disengaged position being disengaged from the first rotary member, the second rotary member being located in the engaged position when the presser-foot lifting lever is moved from the lifted position to the lowered position and being located in the disengaged position when the presser-foot lifting lever is moved from the lowered position to the lifted position.

3. The device according to claim 2, wherein the first rotary member comprises a first gear that is provided at the presser-foot lifting lever and the second rotary member comprises a second gear that is capable of rotating in mesh with the first rotary member.

4. The device according to claim 3, wherein the second gear is located above the first gear and is supported by a support shaft secured to the sewing machine head so as to be swingable by weight of the speed restraining element, the second gear being positioned in the engaged position by the weight of the speed restraining element when the presser-foot lifting lever is moved from the lifted position to the lowered position and being positioned in the disengaged position against the weight of the speed restraining element when the presser-foot lifting lever is moved from the lowered position to the lifted position.

5. The device according to claim 4, wherein the presser-foot lifting lever is swingably supported by a lever shaft secured to the sewing machine head and the support shaft, and wherein the lever shaft, the first gear, and the second gear are disposed such that a sum of a distance between an axial center of the support shaft and a rotational center of the second gear and a radius of a pitch circle of the second gear is greater than a difference obtained by subtracting a radius of a pitch circle of the first gear from a distance between an axial center of the support shaft and an axial center of the lever shaft.

6. The device according to claim 3, wherein a pitch circle of the first gear is decentered by a predetermined distance from an axial center of the lever shaft.

7. The device according to claim 4, wherein a pitch circle of the first gear is decentered by a predetermined distance from an axial center of the lever shaft.

8. The device according to claim 5, wherein the pitch circle of the first gear is decentered by a predetermined distance from an axial center of the lever shaft.

9. The device according to claim 3, wherein the first gear comprises a main gear that is provided at the presser-foot lifting lever and at least one sub gear that transmits rotational force of the main gear to the second gear.

10. The device according to claim 4, wherein the first gear comprises a main gear that is provided at the presser-foot lifting lever and at least one sub gear that transmits rotational force of the main gear to the second gear.

11. The device according to claim 5, wherein the first gear comprises a main gear that is provided at the presser-foot lifting lever and at least one sub gear that transmits rotational force of the main gear to the second gear.

12. The device according to claim 6, wherein the first gear comprises a main gear that is provided at the presser-foot lifting lever and at least one sub gear that transmits rotational force of the main gear to the second gear.

13. The device according to claim 7, wherein the first gear comprises a main gear that is provided at the presser-foot lifting lever and at least one sub gear that transmits rotational force of the main gear to the second gear.

14. The device according to claim 8, wherein the first gear comprises a main gear that is provided at the presser-foot lifting lever and at least one sub gear that transmits rotational force of the main gear to the second gear.

15. The device according to claim 1, wherein the speed restraining element includes:

a third rotary member that rotates in conjunction with presser-foot lifting lever; and a movable member that is provided at the speed restraining element and that is movable in engagement with the third rotary member, the movement of the movable member being slowed down by the resistance, and wherein the movement of the movable member is slowed down when the presser-foot lifting lever is moved from the lifted position to the lowered position and is not slowed down when the presser-foot lifting lever is moved from the lowered position to the lifted position.

16. The device according to claim 15, wherein the third rotary member comprises a third gear provided at the presser-foot lifting lever and the movable member comprises a fourth gear that is movable in mesh with the third gear.

17. A sewing machine comprising:

a sewing machine head;

a presser bar supported by the sewing machine head so as to be movable up and down;

a presser foot provided at a lower end of the presser bar;

a presser spring that elastically biases the presser foot downward;

a presser-foot lifting lever that is moved between a lifted position and a lowered position for lifting/lowering of the presser foot;

a speed restraining element that produces resistance capable of slowing down the movement of the presser-foot lifting lever; and a speed-restraint switch mechanism that slows down the movement of the presser-foot lifting lever by allowing the speed restraining element to produce the resistance when the presser-foot lifting lever is moved from the lifted position to the lowered position, and that does not slow down the movement of the presser-foot lifting lever by not allowing the speed restraining element to produce the resistance when the presser-foot lifting lever is moved from the lowered position to the lifted position.

* * * * *